United States Patent [19]

Levine

[11] 4,096,629

[45] Jun. 27, 1978

[54] MULTIPLE BLADED RETRACTABLE CLAW WEAPON

[76] Inventor: Alfred B. Levine, 2924 Terrace Dr., Chevy Chase, Md. 20015

[21] Appl. No.: 797,231

[22] Filed: May 16, 1977

[51] Int. Cl.[2] ..... B26B 1/02; B26B 1/08; B26B 27/00

[52] U.S. Cl. ..... 30/152; 30/15.5; 30/162; 30/298; 30/304

[58] Field of Search ..... 30/152, 154, 158, 159, 30/160, 162, 164, 298, 304, 305, 315, 317, 299, 322, 323; 273/84

[56] References Cited

U.S. PATENT DOCUMENTS

| | | | |
|---|---|---|---|
| 1,274,358 | 7/1918 | Hotham | 30/322 |
| 1,586,906 | 6/1926 | Lewis | 30/317 X |
| 2,099,447 | 11/1937 | Matsuyama | 273/84 R |
| 2,197,650 | 4/1940 | Piper | 30/304 |
| 2,232,321 | 2/1941 | Gibson | 30/304 X |
| 2,383,957 | 4/1945 | Cosneck | 30/304 X |
| 2,705,832 | 4/1955 | Mirando | 30/159 |
| 2,741,025 | 4/1956 | Stewart | 30/368 X |
| 2,986,815 | 6/1961 | Fernald | 30/304 |
| 3,049,182 | 8/1962 | Pelow | 30/164 X |
| 3,593,803 | 7/1971 | Ibach | 30/298 X |

FOREIGN PATENT DOCUMENTS

| | | | |
|---|---|---|---|
| 445,296 | 11/1912 | France | 30/304 |
| 2,522,198 | 11/1976 | Germany | 30/303 |
| 1,334,383 | 10/1973 | United Kingdom | 30/304 |

*Primary Examiner*—N. P. Godici

[57] ABSTRACT

A pocket-sized claw-like multibladed weapon adapted to be held in the closed fist with the blades being spaced apart and projecting outwardly between adjoining fingers; likened to animal claws or talons of birds of prey. For storage and handling of the weapon, the blades are retractable, foldable, pivotable, and/or otherwise reposable in a confined manner, so that the weapon may be safely carried in the user's pocket or purse while occupying a minimal space. The weapon may be rapidly converted or erected from its reposed condition to its activated position when required.

11 Claims, 14 Drawing Figures

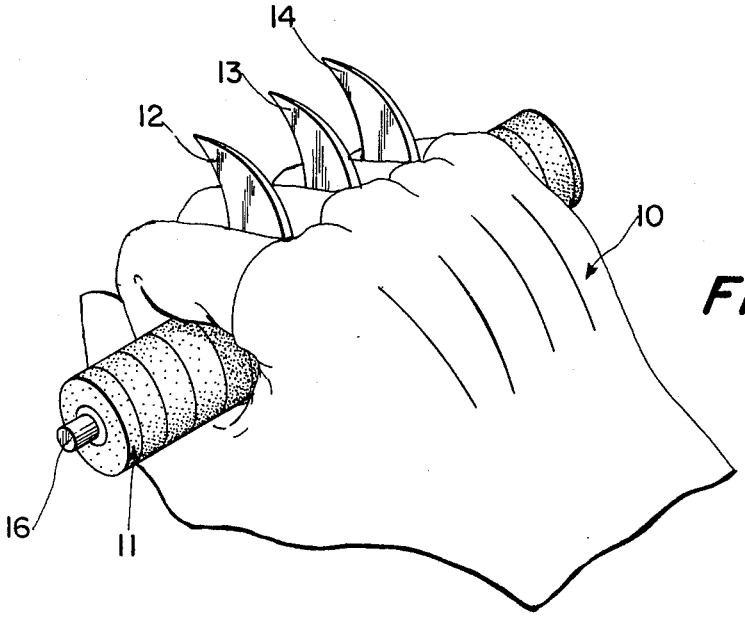
FIG. 1
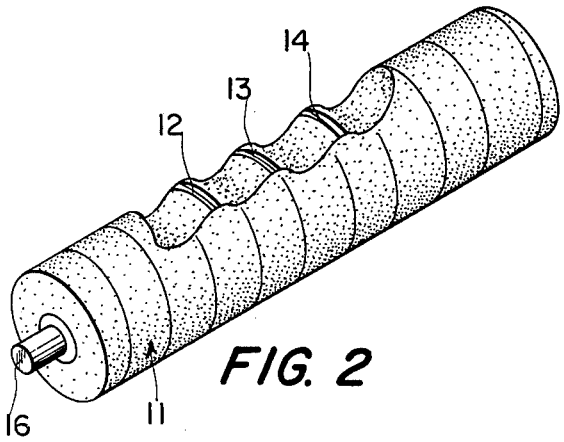
FIG. 2
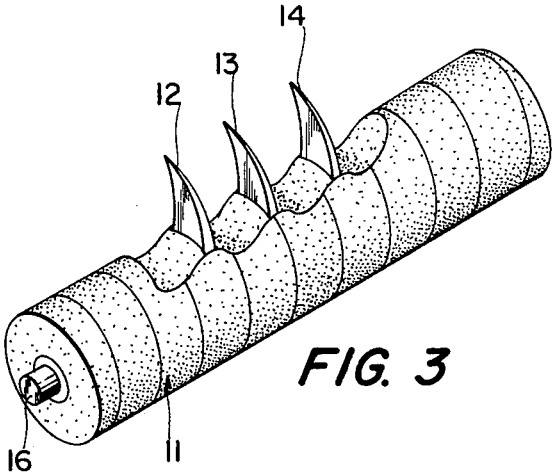
FIG. 3
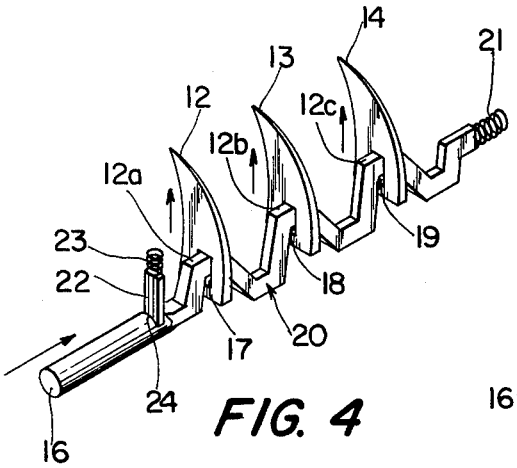
FIG. 4
FIG. 5
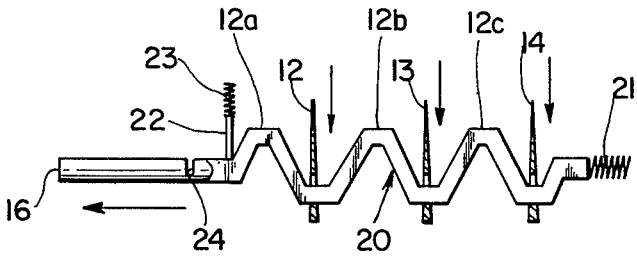

MULTIPLE BLADED RETRACTABLE CLAW WEAPON

BACKGROUND AND STATEMENT OF PRIOR ART

This invention generally relates to miniaturized bladed weapons that are particularly useful for purposes of self-defense by women against attackers, and is particularly concerned with such a multibladed weapon that may be safely carried and stored in a collapsed condition within a small space yet be rapidly activated when needed to repel an attacker.

In the wilderness, the usual carnivorous animal or bird of prey is provided by nature with sharp claws to both attack and subdue its prey, as well as to defend itself against predatory animals so as to insure its survival. The human animal, however, is not provided by nature with such naturally occurring weapons and therefore must provide for its defense against predatory humans by the use of artificial weaponry.

In the overpopulated cities of present day society, women have increasingly become exposed to dangers from muggers and rapists; and in many cities, are in contant concern and fear of being alone and unprotected at night, even when indoors.

For self-protection of such persons, conventionally available weapons, such as ordinarily available knives and hand-guns, do not provide a satisfactory solution, since the use of hand-guns is outlawed in many cities; and even where permitted, requires a certain degree of training and skill in usage that many women do not have and prefer not to acquire. Conventional knives, billy clubs, and other common weapons, on the other hand, are not generally useful devices for women since they are of the wrong shapes, sizes, and configurations to be easily carried in the pocket or purse, as well as often requiring some degree of strength, or skill, or training in their effective uses that many women do not possess; and like the hand-guns, do not wish to acquire. There exists a need therefore for a small, portable knife or bladed weapon that can be carried with safety and convenience by the user, yet can be rapidly activated when needed to repel an attack and protect the attacked person. Most importantly, there exists a need for such a weapon that can be effectively used by women and others needing a protective weapon, without the need for having any particular degree of skill, degree of strength, or advanced training in order to render the weapon effective for its intended purpose.

In the past many non-conventional knives and blades have been proposed for different purposes that are carried by and supported by the human hand, arm, or fingers, with many being used for cutting, scraping, or tearing. For example, a finger supported single bladed tool is shown in the early Walker et al. U.S. Pat. No. 515,066 and Gibson No. 456,812 for use in severing bands or twine. Similarly, in the more recent Addis U.S. Pat. No. 3,839,788 a finger supported skinning knife is disclosed. In Knoteson U.S. Pat. No. 2,178,019, a bladed tool is supported by a holder encircling the hand, and in Dunham U.S. Pat. No. 1,523,059, a grape picking knife employs a single cutting blade attached to the forefinger. Many non-conventional multiple bladed knives and cutting tools have also been proposed for use as weapons as well as for various industrial and agricultural purposes. For example, in Iback U.S. Pat. No. 3,593,803 there is shown a glove having cutting elements associated with the finger portions, and in Winzenried U.S. Pat. No. 310,108 individual, unattached cutters are supported by the different fingers for use in harvesting cotton. Multiple bladed knives are also disclosed in U.S. Pat. Nos. 2,383,957 and 2,352,921 that are adapted to be fastened to the arms, and in others, the blades are fastened to the legs or to the feet.

SUMMARY OF THE INVENTION

According to the present invention there is provided a multibladed weapon that may be likened in general appearance and function to retractable animal claws or talons, and that may be used in the same general manner as such naturally occuring weapons of animals to repel an attack by others. This weapon comprises a series of spaced apart blades, each having a surface for cutting or tearing, that are adapted to be held in the closed fist for the user with the individual blades projecting outwardly between the fingers and with the cutting edges facing the attacker. A suitable holder mechanism is enclosed within the fist and attaches to the multiple blades so that the blades are firmly retained in place by the user gripping the holder mechanism in the clenched fist. In use, this "artificial claw" is employed in the same general manner as is the natural claws or talons of animals or birds to provide a "cutting or slashing" action as the hand is raked across the face or body of the attacker. Since the use of the weapon is similar to that naturally occurring in nature, no special skills, training, or particular degree of strength is required on the part of the user who merely responds to attack in a natural manner by lashing outwardly with the hands to repel the attacker.

In preferred embodiments, the blades are made rather small in size, are spaced apart in parallel, and are movably combined in such manner with the holder mechanism that they are readily retracted or collapsed in a reposed condition when not in use so as to be safely carried in the hand, pocket, or purse, without danger of cutting the user. The collapsed or otherwise folded together blades and holder are also constructed to occupy a minimum of space and to be light-in-weight, thereby affording the user with a more practical weapon that can be inconspiciously carried about and yet be readily activated for defense when needed.

SUMMARY OF THE DRAWINGS

FIG. 1 is a schematic illustration, in perspective view, showing the manner of using the weapon in a clenched human fist, FIG. 2 is a perspective view of a preferred embodiment having the blades in retracted, concealed position, FIG. 3 is a perspective view similar to FIG. 2, showing the blades in an extended position in readiness for use, FIG. 4 is a perspective view of the internal mechanism with the blades extended, FIG. 5 is a cross-sectional view of FIG. 2, showing the internal mechanism with the blades retracted.

DETAILED DESCRIPTION OF PREFERRED EMBODIMENT

Figure 6:
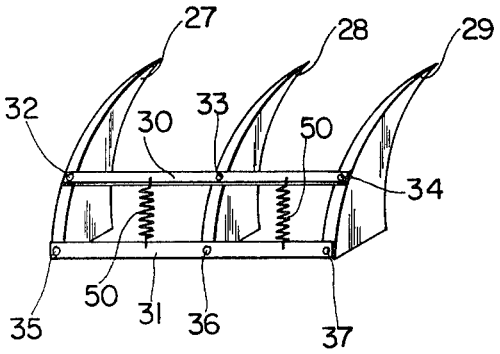
FIG. 6 is a perspective view of a different embodiment, employing pivotally moveable blades.

Referring to FIG. 1, there is generally illustrated a human fist 10 and the manner of holding and using an embodiment of the activated weapon in the fist. As shown, the weapon includes a hand holder portion or handle 11 for supporting a plurality of spaced apart flat blades 12, 13, and 14 that project upwardly and outwardly in a direction generally transverse to the handle 11. In use, the handle portion 11 is firmly gripped within the enclosed fist 10 with the blades 12, 13, 14 extending outwardly between the fingers, in a manner similar to animal claws or talons. To repel an attacker, the user of this weapon merely applies the "claws" in the normal expected manner of a human or animal defending itself by a downwardly arcing motion of the first toward the attacker's face or body, whereby the extended "claw" blades tear or rake the attacker's skin to discourage further advances.

In FIGS. 2 and 3, are shown details of a preferred embodiment of the weapon; showing in FIG. 2, the weapon on a "reposed" condition for safe storage or carrying, with the blades 12 to 15, inclusive, being retracted into the handle 11 for safety; and showing in FIG. 3, the weapon in an "activated" condition with the blades 12 to 15 projecting from the handle 11 in readiness for use.

For quickly activating the weapon from its reposed condition of FIG. 2 to its activated condition of FIG. 3, there is provided a projection mechanism disposed inside of the handle 11, that is actuated in response to manual thumb pressure applied to a push knob 16 projecting from the end face of the handle 11.

As is shown in FIG. 2, in the reposed condition of the weapon, the push knob 16 is extended from the end of the handle 11 and projects for a considerable distance. In FIG. 3, this knob 16 has been depressed inwardly by the thumb of the user to activate the internal mechanism for projecting the cutting blades 12 to 15 outwardly from the handle 11 to activate the weapon in readiness for use.

FIGS. 4 and 5 illustrates a preferred form of the internal projecting mechanism, disposed inside of the handle 11, for selectively advancing and retracting the blades 12 to 15 from the handle 11 in response to thumb pressure applied to the push knob 16. As shown, the lower portions of each of the blades 12, 13, and 14 is provided with a suitable opening or slot 17, 18, and 19, respectively, that is located inside of the hollow handle 11 and substantially in axial alignment with the central axis of the push knob 16. Connected to the push knob 16, inside of the handle 11, is provided an elongated camming shaft 20 that extends along this axis, substantially the entire length inside of the handle 11, and shaft 20 passes through each of the slots 17, 18, and 19 of the blades. The camming shaft 20 is formed in an undulating manner, providing an alternating series of upper and lower camming surfaces 12*a*, 12*b*, 13*a*, 13*b*, 14*a*, and 14*b*, transversely displaced away from the central axis of the shaft 20, with each adjoining pair of such disposed camming surfaces being selectively associated with a different one of the blades. For example, cam surfaces 12*a* and 12*b* are associated with blade 12; cam surfaces 13*a*, 13*b* with blade 13, and cam surface 14*a* and 14*b* are associated with blade 14.

The shaft 20 is suitably supported by slide bearings (not shown) located inside of the handle 11, and is adapted for limited movement axial displacement into and out of the handle 11 to selectively project and retract the blades. As shown in FIG. 4, when the shaft 20 is axially displaced inwardly into the hollow handle 11 by thumb depression on the outside push knob 16, the upper camming surfaces 12*a*, 13*a*, and 14*a* are forced into interengagement with the upper edges of the slots 17, 18, and 19 of the blades 12, 13, and 14, respectively, and serve to simultaneously elevate or project the blades upwardly and out of the hollow handle 11 to the activated position shown in FIG. 3. On the other hand, when the shaft 20 is partially withdrawn (outwardly) from the hollow handle 11 as in FIG. 5, the lower cam surfaces 12*b*, 13*b*, and 14*b* are forced into interengagement with the lower edges of the slots 17, 18, and 19 of blades 12, 13, and 14, respectively, and operate to simultaneously depress the blades downwardly into the hollow handle 11, and into the reposed or inactive condition of the weapon as illustrated in FIG. 2 and FIG. 5.

As also shown in FIGS. 4 and 5, the shaft 20 is normally based outwardly by an axially positioned compression spring 21 at its inside end to maintain the blades 12, 13, and 14 downwardly and in the concealed position of FIG. 2, inside of the hollow handle 11. Depression of the push knob 16 inwardly by the thumb to activate the weapon, forces the shaft 20 inwardly against the spring 21 to partially compress the spring 21. When the weapon is fully activated to project the blades 12, 13, 14, the internal camming shaft 20 is sufficiently displaced inwardly into the hollow handle 11, to a position where a lock pin 22, inside the handle 11, automatically enters a slot 24 formed in the shaft 20. As shown, the lock pin 22 is automatically forced into the slot 24 by the expanding action of a small compression spring 23 that forces it downward into slot 24, thereby to automatically lock the weapon in its activated position when the thumb push knot 16 is sufficiently depressed inwardly. Suitable means, including a disengaging lever (not shown), are provided to permit manual withdrawal of the lock pin 22 from slot 24 when the user wishes to ultimately deactivate the weapon. Upon withdrawal of the pin 22 from slot 24, the compressed spring 21 acting against the camming shaft 20 serves to automatically return the shaft 20 to its more outward position from the handle 11, permitting the lower cam surfaces 12*b*, 13*b*, and 14*b* to automatically retract the cutter blades 12, 13, and 14 backwardly into the handle hollow 11, as shown in FIGS. 2 and 5.

Figure 7:
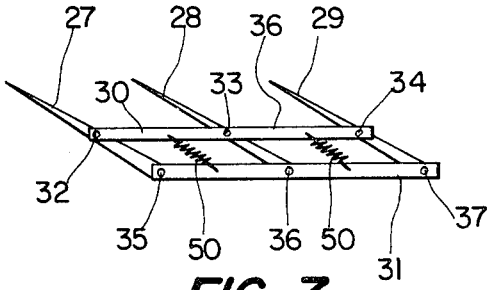
FIG. 7 is a perspective view of the embodiment of FIG. 6 with the blades pivoted for storage.

FIGS. 6 and 7 illustrate an alternative miniaturized embodiment of the weapon having plural flat blades 27, 28, and 29 that pivot or fold about an axis transverse to the forward cutting edges of the blades. As shown, the blades are axially spaced apart from one another, by a distance approximating the width of fingers, and are each pivotally connected at their rear edges to a spaced pair of upper and lower rigid strips or rods 30 and 31, respectively. The vertical spacing between the upper and lower strips 30 and 31 is sufficient to permit insertion of the fingers there between, whereby the lower strip or rod 31 is adapted to be enclosed within the human fist in the manner of a handle, and the upper strip 30 passes over the outside of the fingers. Blade 27 is pivotally connected to strip 30 at 32 and to strip 31 at 35. Similarly, blade 28 is pivotally connected to both members at 33 and 36; and blade 29 at 34 and 37, respectively.

For convenience and safety in storage and handling, the blades are conjointly diplaced or folded to the side, and into the generally flattened condition as shown in FIG. 7. A flat case or pocketed cover (not shown) may be provided to enclose the weapon when folded (FIG. 7) for the safety of the user when carrying in the pocket or purse. To more rapidly activate the weapon from the reposed position of FIG. 6 to the activate position of FIG. 7, compression springs 50 may be provided between rod or strip members 30 and 31 to normally maintain these members spaced apart as in FIG. 6, whereby when the weapon is withdrawn from its flat case or holder, it automatically erects from its flattened to its upright activated condition by action of erecting springs 50.

Figure 8:
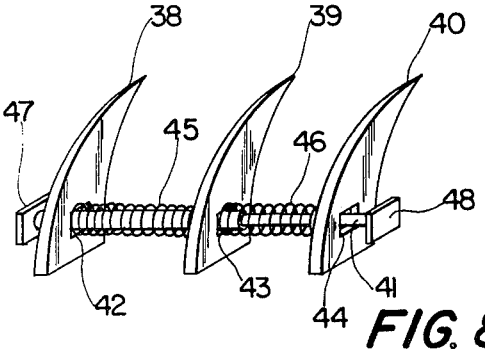
FIG. 8 is a partial perspective view of a still further embodiment, employing slidably mounted blades.
Figure 9:
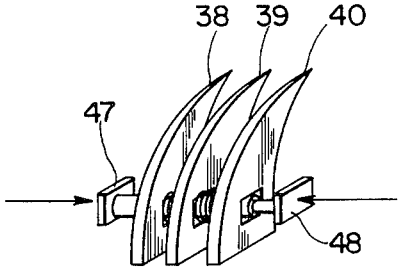
FIG. 9 is a partial perspective view of the embodiment of FIG. 8 showing the weapon collapsed for storage.

In the different embodiment of FIGS. 8 and 9, a plurality of blades 38, 39, and 40 are slidably mounted on a suitable guideway or support shaft 41 that also functions as the handle portion for the weapon. In the simplified construction shown, each of the blades is provided with an opening or slot 42, 43, 44, respectively, as shown, through which the support shaft 41 passes. To provide a compact weapon for storage and carrying in the pocket, the shaft 41 is preferably constructed of telescoping sections (not shown) and having end stops 47 and 48. In this manner, the shaft 41 may be telescopically collapsed to bring the blades close together, side-by-side, as shown in FIG. 9, thereby to occupy less space in the pocket or purse; and may be axially extended to the activated position of FIG. 8 in readiness for use. For automatic activation of the weapon, a coil spring 45 may be provided about the portion of the shaft 41 located between the blades 38 and 39 and a second coil spring 46 may be disposed between the blades 39 and 40, whereby the pair of springs 45 and 46 serve to automatically extend the telescoping extendable shaft 41 and to automatically space apart the blades 38, 39, and 40 to their activated relationship upon removal of the weapon from its confining case or holder (not shown).

Figure 10:
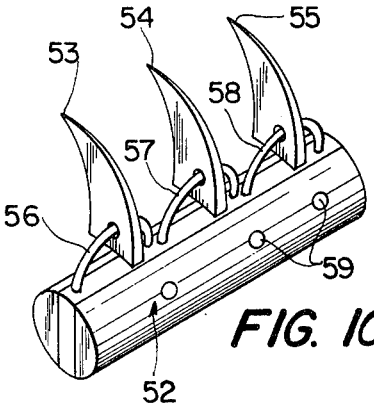
FIG. 10 is a partial perspective view of a still additional embodiment, employing differently pivotable blades.

In a still further embodiment as disclosed in FIG. 10, the weapon employs a substantially rigid handle portion 52 together with a series of spaced apart blades 53, 54, and 55 that are rather loosely individually, pivotally supported on the handle 52 by loops 56, 57, and 58 passing through openings **56*a*, 57*a*, and 58*a*, provided in the blades 53, 54, and 55, respectively. In this arrangement, like that of FIGS. 6 and 7, the blades pivot about an axis transverse to the cutting edges thereof. However, unlike the configuration of FIGS. 6 and 7, the blades are not otherwise connected together and can individually pivot about the handle portion 52. For storage and handling, the blades 53, 54 and 55** may be folding downwardly to the side, and the entire weapon, in reposed condition, may be inserted into a holder or case (not shown).

Figure 11:
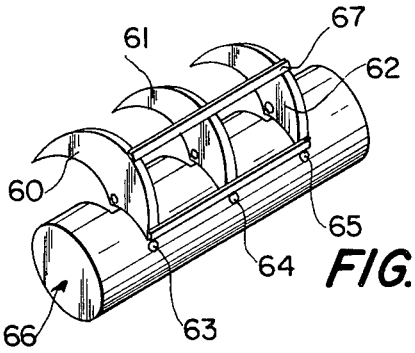
FIG. 11 is a partial perspective view of a still further embodiment having pivotally supported blades, that pivot in the plane of the cutting edges.

In an additional embodiment shown in FIG. 11, the weapon may be constructed to have the blades pivot in the planes of their cutting edges, instead of tranversely thereto as in FIG. 6, 7, and 10. As shown, the blades 60, 61, and 62 are each pivotally supported at 63, 64 and 65, respectively, to a handle member 66, thereby to pivot transversely with respect to the central axis of handle 66 to a "reposed" or safety position when not in use. A rigid connecting bar or rod 67 is attached to all of the blades 60, 61, and 62 at their back edges for enabling the blades to be selectively opened or closed in unison. The handle 66 may be provided with spaced apart slots or grooves in alignment with the blades to receive and cover the cutting edges thereof when the blades are folded, thereby to protect the user during storage and handling.

Figure 12:
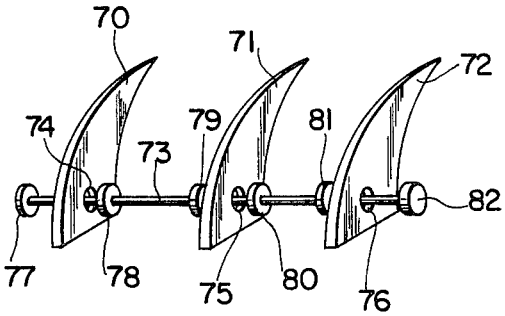
FIG. 12 is a partial perspective view of a further embodiment.
Figure 13:
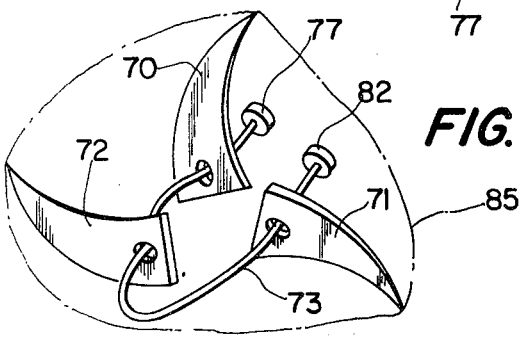
FIG. 13 is a plan view of the embodiment of FIG. 12, with the blades collapsed for storage.

In the embodiment of FIGS. 12 and 13, the plural blades 70, 71, and 72 are carried by a handle 73 of flexible or yieldable material, e.g., thin plastic covered cable or the like, that passes through openings 74, 75, and 76, respectively, through the lower portions of the blades. For suitably spacing the blades apart at the approximate width of the human fingers, pairs of stops may be provided on the cable 73 on opposite sides of each blade, with each pair of stops being spaced from the next by a finger width. For example, stops 77 and 78 maintain the position of blade 70 on cable 73 by a finger width spacing from the next pair of stops 79 and 80 that determine the location of blade 71. Similarly stops 81 and 82 maintain the position of remaining blade 72 at the proper finger width spacing from previous blade 71.

One of the virtues of this construction is that the weapons may be collapsed for storage to a thickness only slightly greater than the thickness of a single blade, as shown in FIG. 13. In FIG. 13, the flat blades 70, 71, 72 are turned sideways, to their flattened sides, and compactly arranged for storage in a flat circular disc - like case or holder 85 in a side-by-side arcuate configuration shown.

Figure 14:
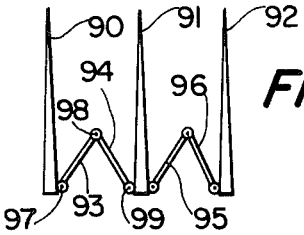

In the remaining disclosed embodiment of FIG. 14, shown in end view, the plural blades 90, 91, and 92, are interconnected by a folding linkage handle. In this arrangement, blades 90 and 91 are interconnected by rigid links 93 and 94 that pivot at 97, 98, and 99. In a similar manner, blades 91 and 92 are interconnected by rigid links 95 and 96 that also pivot at each juncture. In this manner, the three blades may be folded up together in flat side-by-side arrangement for storage or carrying, and rapidly extended apart for use of the weapon by merely straightening out the links to provide a handle to be encircled by the fingers. A suitable flat case or clamp (not shown) may be provided for safely carrying the bladed weapon.

It will be noted that in all of the disclosed embodiments, the claw-like weapon is "activated" with the plural blades being disposed parallel to one another and spaced apart by finger widths so as to be retained in the closed fist, as shown in FIG. 1. In all embodiments also, the weapon is adapted to be collapsed, folded, pivoted, or otherwise converted from its activated condition to a reposed condition to protect the user during storage and handling and to occupy a considerably smaller space in storage then when activated for use. Although but a limited number of embodiments have been disclosed it will be appreciated that related or equivalent means may be provided for collapsing the blades for storage and for activating the weapon in readiness for use. The shape and configuration of the blades may be varied, as desired, to provide merely a sharp claw-like point, a flat sharp bladed edge, a serrated edge or other cutting edge as may be desired. The materials used may also be varied including metals, plastics, or other materials for the blades, handles pivots, cables, rods and other elements shown and described. Since these and many other changes may be made without departing from the scope of this invention, this invention should be considered as being limited only by the following claims.

What is claimed is:

1. An artificial claw weapon comprising:

a handle means having a shape to be substantially entirely enclosed within the encircling fingers of a closed human fist, a plurality of claw-shaped blade members spaced apart from one another along the length of the handle means and projecting transversely and substantially unidirectionally from the handle means with the spacing between adjoining blade members corresponding to the width of a human finger, whereby the blades may be interdigitated between the fingers and project outwardly from the fist when the handle means is enclosed by the fist, and means movably attaching the blade members to the handle means for varying the orientation of the blade memebers with respect to the longitudinal axis of the handle means to an inactive, more compact, reposed condition, thereby to provide ease and safety in the storage and carrying of the claw weapon in the pocket and purse of the user.

2. In the weapon of claim 1, said blade members being normally retained in said reposed condition spaced apart inside of said handle means, and means for erecting said blade members between the fingers to project unidirectionally outside of said handle means to provide said artificial claw weapon while said handle means is confined inside of said closed fist.

3. In the weapon of claim 1, said blade members being pivotally supported by said handle means, and said handle means being articulated with the portions thereof being pivotally connected.

4. In the device of claim 2, said erecting means including a lever member disposed inside of said handle means for rectilinear movement transverse to said blade members, said lever having cammed surfaces engageable with said blade members to erect said blade members upon the positioning of said lever toward said handle means.

5. In the device of claim 1, said plurality of blade members being mounted for pivotal movement together about an axis substantially transverse to the cutting surfaces thereof when erected.

6. In the device of claim 1, said plurality of blade members being mounted for pivotal movement together about axis substantially parallel to the cutting surfaces thereof.

7. In the device of claim 1, said plurality of blade members being mounted for sliding movement along an axis substantially transverse to the cutting surfaces thereof.

8. In the device of claim 1, said plurality of blade members being individually mounted for pivotal movement about an axis substantially parallel to the cutting surfaces thereof.

9. In the device of claim 1, said blade members having portions thereof spaced apart from each other by about the thickness of the human finger, and being pivotally supported near said portions.

10. In the device of claim 1, said blade members being supported by a non-rigid handle member.

11. In the device of claim 1, said blade members being movably supported with respect to a rigid handle member.

* * * * *